US011069967B2

(12) United States Patent
Evans

(10) Patent No.: US 11,069,967 B2
(45) Date of Patent: Jul. 20, 2021

(54) SATELLITE DISH COVER APPARATUS

(71) Applicant: Dwayne Evans, Atlanta, GA (US)

(72) Inventor: Dwayne Evans, Atlanta, GA (US)

( * ) Notice: Subject to any disclaimer, the term of this patent is extended or adjusted under 35 U.S.C. 154(b) by 251 days.

(21) Appl. No.: 16/418,404

(22) Filed: May 21, 2019

(65) Prior Publication Data

US 2020/0373656 A1 Nov. 26, 2020

(51) Int. Cl.
*H01Q 1/42* (2006.01)
*H01Q 15/16* (2006.01)

(52) U.S. Cl.
CPC ..... *H01Q 1/42* (2013.01); *H01Q 15/16* (2013.01)

(58) Field of Classification Search
CPC ..... H01Q 1/42; H01Q 19/132; H01Q 19/12; H01Q 15/16; H01Q 1/02
USPC ..... 343/872
See application file for complete search history.

(56) References Cited

U.S. PATENT DOCUMENTS

D304,454 S 11/1989 Serres
5,528,253 A 6/1996 Franklin
5,940,047 A * 8/1999 Pfnister ..... H01Q 19/132 343/872
6,714,167 B1 * 3/2004 Gusick, Jr. ..... H01Q 1/42 343/872
7,215,300 B1 5/2007 Reid, Jr.
7,388,558 B1 6/2008 Jacoletti
2006/0092089 A1 * 5/2006 Courtney ..... H01Q 1/42 343/872
2016/0190680 A1 * 6/2016 Phipps ..... H01Q 1/42 343/840

* cited by examiner

*Primary Examiner* — Alexander H Taningco
*Assistant Examiner* — Amy X Yang

(57) ABSTRACT

A satellite dish cover apparatus for protecting a satellite dish and preventing signal interference includes a main dish cover comprising a circular front panel, a perimeter extension, and a rounded back panel. The back panel has an installation aperture configured to receive a satellite dish such that a front face of the satellite dish is fully covered by the front panel. A feed horn cover hood is coupled to a feed horn cover arm extending from the front panel and is configured to receive the feed horn of the satellite dish. A mounting arm is coupled to the back panel and extends out of the installation aperture. A mounting clamp is coupled to the mounting arm and is configured to selectively engage a support post of the satellite dish.

14 Claims, 5 Drawing Sheets

SATELLITE DISH COVER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to satellite dish accessories and more particularly pertains to a new satellite dish accessory for protecting a satellite dish and preventing signal interference.

BRIEF SUMMARY OF THE INVENTION

An embodiment of the disclosure meets the needs presented above by generally comprising a main dish cover comprising a circular front panel, a perimeter extension perpendicularly extending from a perimeter of the front panel, and a rounded back panel extending from the perimeter extension forming a dish cavity therebetween. The rounded back panel has an installation aperture extending therethrough and configured to receive a satellite dish into the dish cavity such that a front face of the satellite dish is fully covered by the front panel. A feed horn cover arm is coupled to a bottom edge of the front panel and flexibly extends up towards an orthogonal central axis of the front panel. A back side of a feed horn cover hood is coupled to a distal end of the feed horn cover arm and has a front side separated from the back side, a left side separated from a right side, and a top side separated from an open bottom side to form a feed horn cavity configured to receive the feed horn of the satellite dish. A mounting arm is coupled to an inner surface of the back panel and extends out of the installation aperture. A mounting clamp is coupled to the mounting arm and is configured to selectively engage a support post of the satellite dish.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
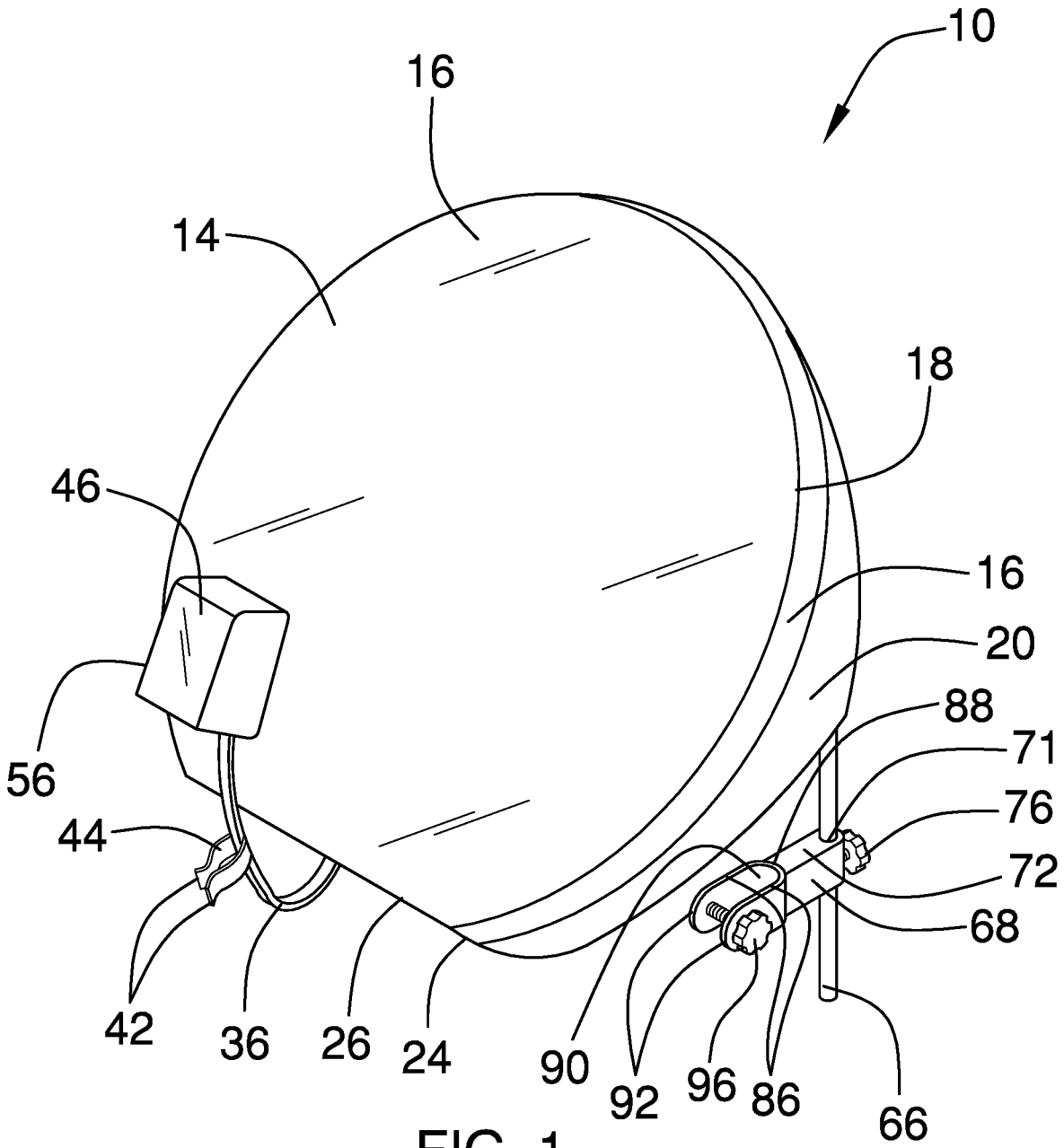
FIG. 1 is an isometric view of a satellite dish cover apparatus according to an embodiment of the disclosure.
Figure 2:
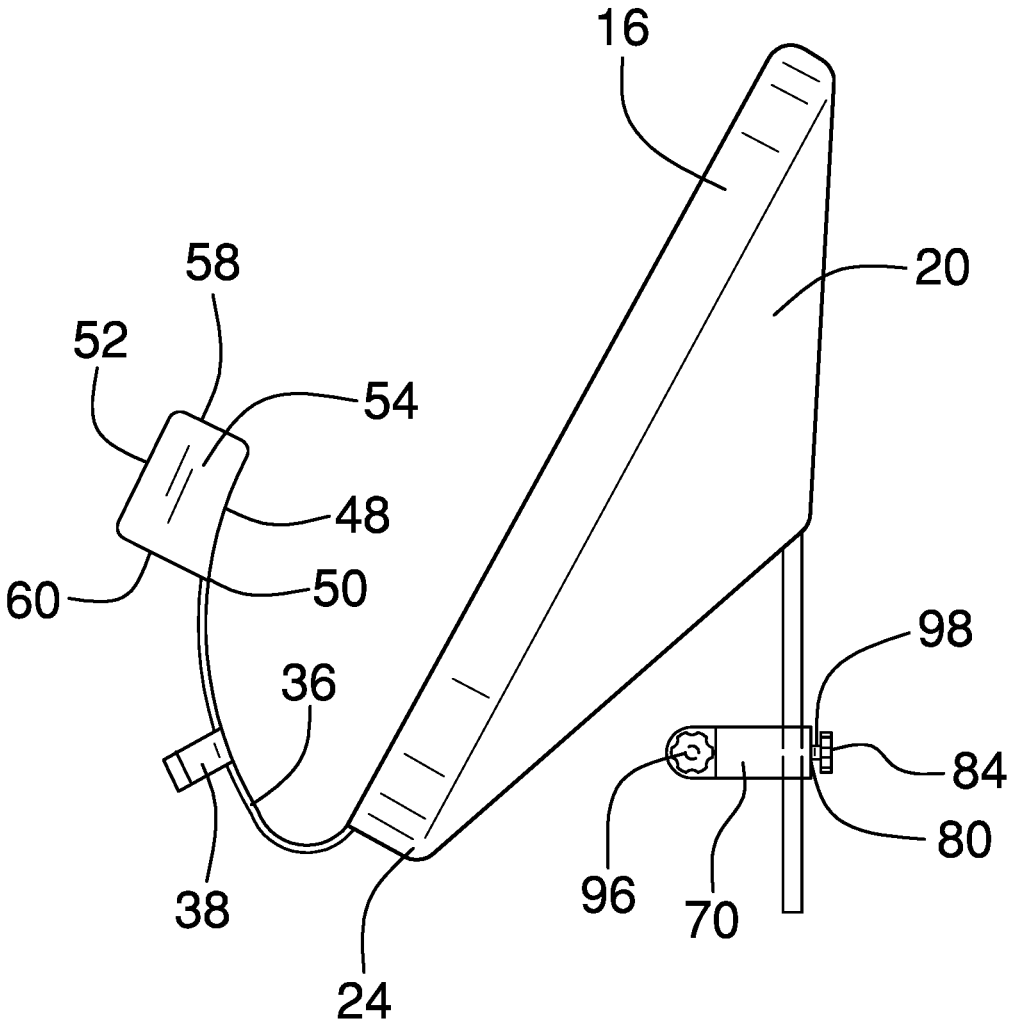
FIG. 2 is a side elevation view of an embodiment of the disclosure.
Figure 3:
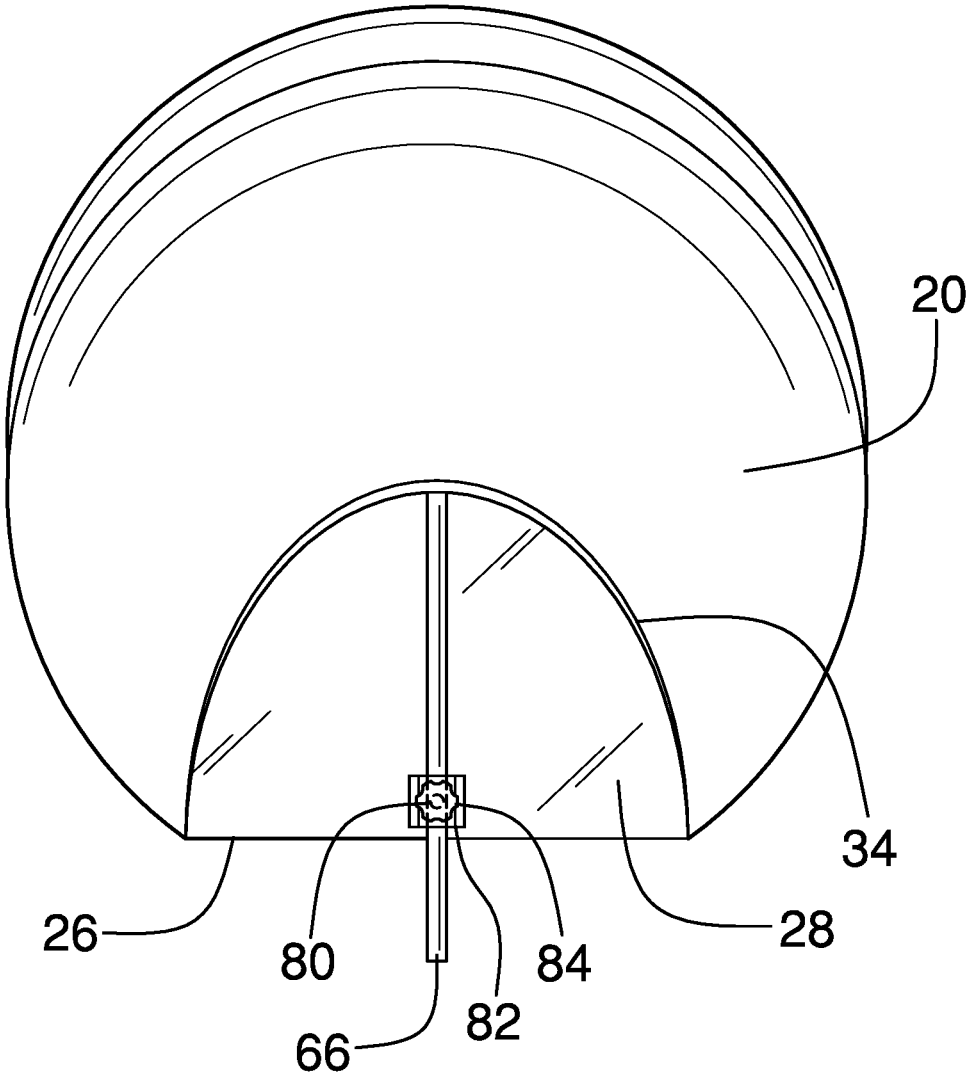
FIG. 3 is a rear elevation view of an embodiment of the disclosure.
Figure 4:
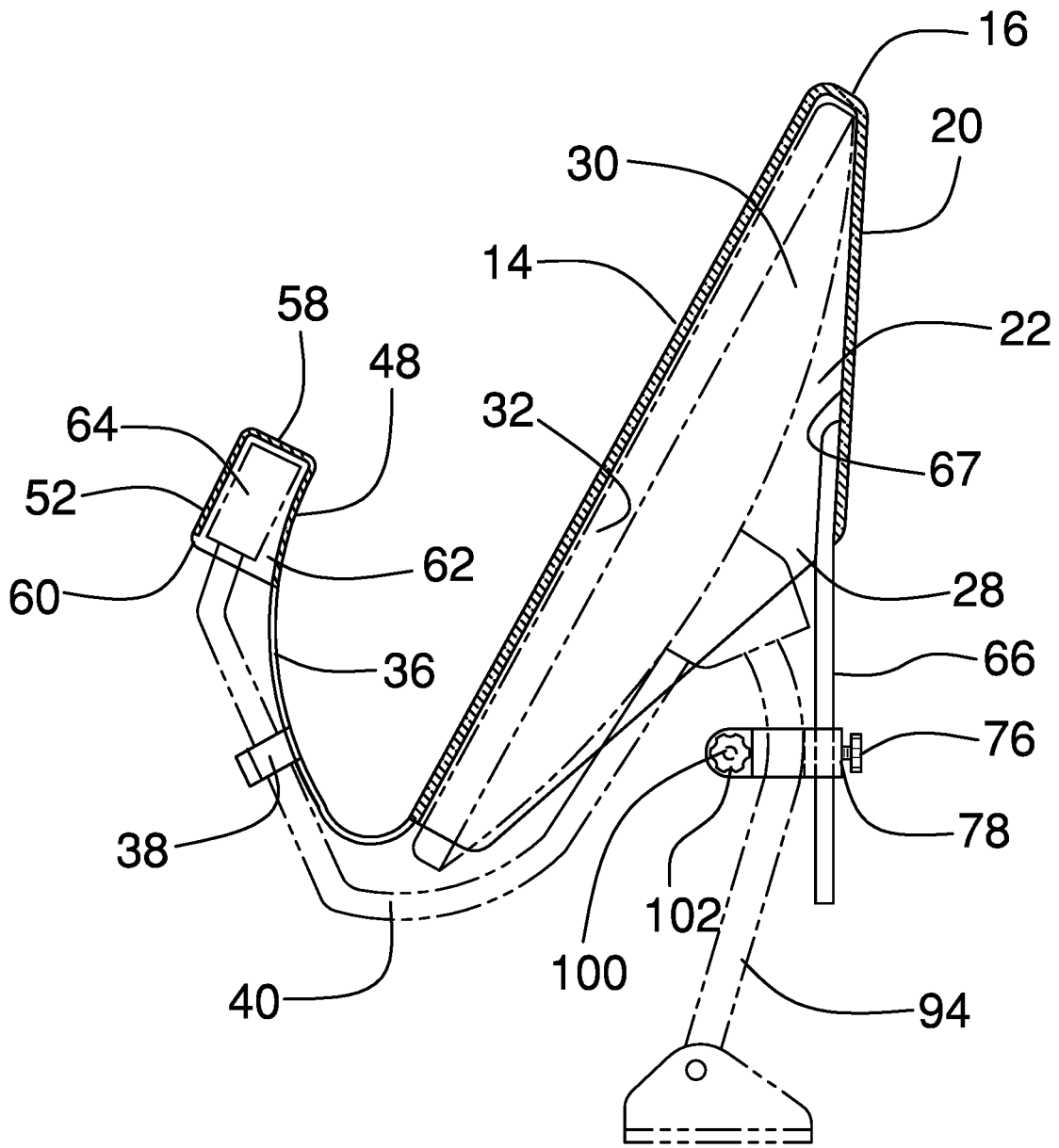
FIG. 4 is a cross-sectional view of an embodiment of the disclosure.
Figure 5:
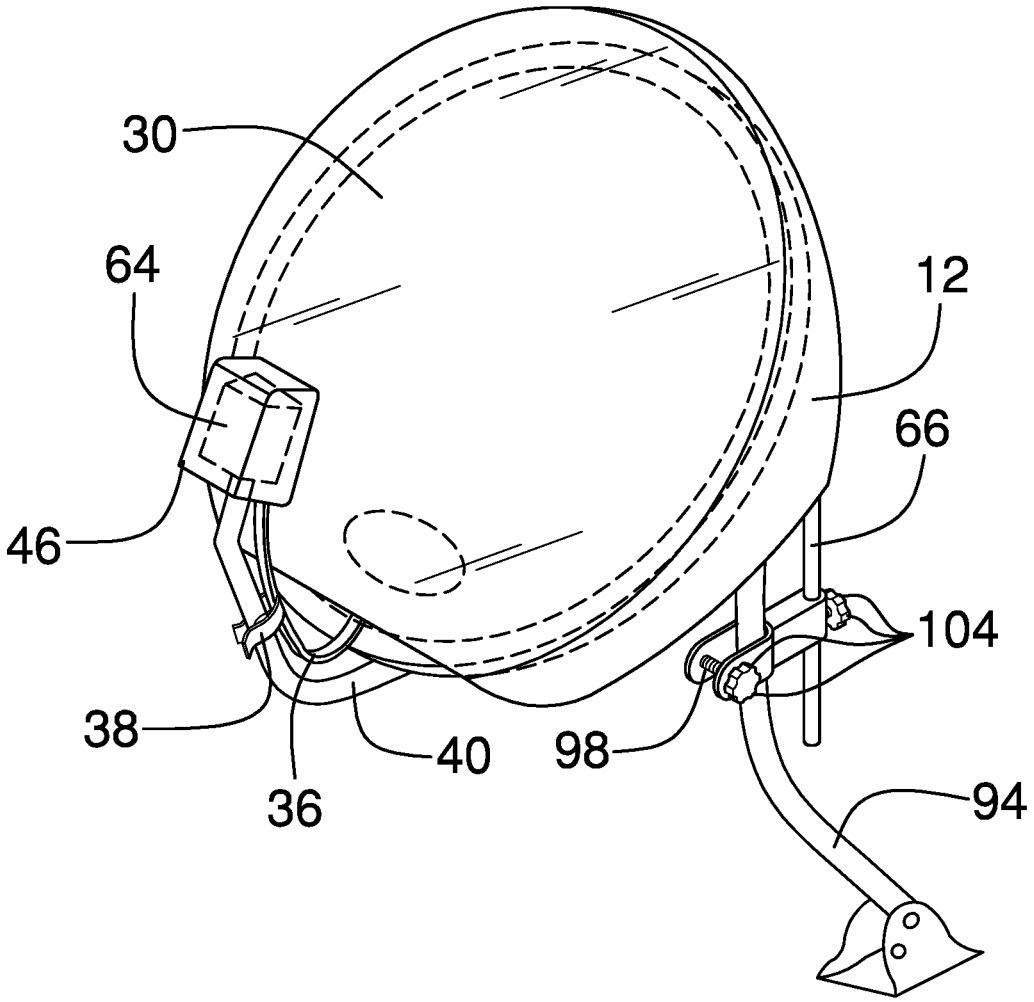
FIG. 5 is an in-use view of an embodiment of the disclosure.

With reference now to the drawings, and in particular to FIGS. 1 through 5 thereof, a new satellite dish accessory embodying the principles and concepts of an embodiment of the disclosure and generally designated by the reference numeral 10 will be described.

As best illustrated in FIGS. 1 through 5, the satellite dish cover apparatus 10 generally comprises a main dish cover 12 comprising a circular front panel 14, a perimeter extension 16 perpendicularly extending from a perimeter 18 of the front panel, and a rounded back panel 20 extending from the perimeter extension 16 forming a dish cavity 22 therebetween. The main dish cover 12 has a truncated bottom side 24 making a bottom edge 26 of the front panel linear. The truncated bottom side 24 makes the perimeter 18 of the front panel between 270° and 330°. The back panel 20 has an installation aperture 28 extending through to the dish cavity 22 and is configured to receive a satellite dish 30 into the dish cavity 22 such that a front face 32 of the satellite dish is fully covered by the front panel 14. The installation aperture 28 has a parabolic profile 34 lying in a plane forming an angle with a plane of the front panel 14 between 20° and 45°. The main dish cover 12 is a transparent, rigid material such as a plastic that is weatherproof and will not interfere with satellite signal.

A feed horn cover arm 36 is coupled to the bottom edge 26 of the front panel and flexibly extends up towards an orthogonal central axis of the front panel 14. A mounting clip 38 is coupled to the feed horn cover arm 36 and is configured to selectively engage a feed horn extension arm 40 of the satellite dish. The mounting clip 38 comprises a pair of curved spring arms 42 forming an omega-shape. The pair of curved spring arms 42 is shaped and flexible such that the mounting clip 38 will spread when pressed onto the feed horn extension arm 40 and then reboundingly close to secure the feed horn extension 40 within a retention area 44 adjacent the feed horn cover arm 36. A feed horn cover hood 46 is coupled to the feed horn cover arm 36. A curved back side 48 of the feed horn cover hood is coupled to a distal end 50 of the feed horn cover arm 36 and has a front side 52 separated from the back side 48, a left side 54 separated from a right side 56, and a top side 58 separated from an open bottom side 60 to form a feed horn cavity 62 configured to receive the feed horn 64 of the satellite dish. The feed horn cover hood 46 is the same material as the main dish cover 12.

A mounting arm 66 is coupled to an inner surface 67 of the back panel 20 and extends out of the installation aperture 28. The mounting arm 66 extends through an apex of the parabolic profile 34 of the installation aperture and lies in a plane forming an angle between 20° and 45° with the plane of the front panel 14. A mounting clamp 68 is coupled to the mounting arm 66 and comprises a clamp body 70 having an arm aperture 71 extending from an upper side 72 through a lower side 74. The arm aperture 71 slidingly receives the mounting arm 66. An adjustment knob 76 is coupled to the clamp body 70. The adjustment knob 76 has a first threaded pin 78 selectively engaged with a threaded adjustment aperture 80 extending through a curved rear side 82 of the clamp body into the arm aperture 71. A first twist handle 84 is coupled to the first pin 78 to engage the first pin 78 with the mounting arm 66. A pair of post tongues 86 is coupled to the clamp body 70 and extends in parallel from a front end 88 of the clamp body to form a post channel 90 therebetween. The pair of post tongues 86 is joined to form a U-shape and an outer end 92 of each of the pair of post tongues 86 is semicircular to prevent injury or damage to the satellite dish 30 during installation. The post channel 90 is configured to slidingly receive a support post 94 of the satellite dish. An engagement knob 96 is coupled to the pair of post tongues 86. The engagement knob 96 has a second threaded pin 98 selectively engaged with a threaded engagement aperture 100 extending through one of the post tongues 86 into the post channel 90. A second twist handle 102 is coupled to the second pin 98 to engage the second pin 98 with the support post 94. Each of the first twist handle 84 and the second twist handle 102 has a plurality of radial grip grooves 104 to prevent slippage.

In use, the apparatus 10 is installed by sliding the satellite dish 30 through the installation aperture 28. The feed horn cover hood 46 is placed over the feed horn 64 and the mounting clip 38 is secured to the feed horn extension arm 40. The main dish cover 12 is adjusted as necessary then secured in place with the mounting clamp 68, tightening both the adjustment knob 76 and the engagement knob 96. The apparatus 10 will then prevent buildup of water, leaves, snow, and other debris that otherwise interfere with satellite signal.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A satellite dish cover apparatus comprising:

a main dish cover, the main dish cover comprising a circular front panel, a perimeter extension perpendicularly extending from a perimeter of the front panel, and a rounded back panel extending from the perimeter extension forming a dish cavity therebetween, the rounded back panel having an installation aperture extending therethrough and configured to receive a satellite dish into the dish cavity such that a front face of the satellite dish is fully covered by the front panel;

a feed horn cover arm coupled to the main dish cover, the feed horn cover arm being coupled to a bottom edge of the front panel and flexibly extending up towards an orthogonal central axis of the front panel;

a feed horn cover hood coupled to the feed horn cover arm, a back side of the feed horn cover hood being coupled to a distal end of the feed horn cover arm and having a front side separated from the back side, a left side separated from a right side, and a top side separated from an open bottom side to form a feed horn cavity configured to receive the feed horn of the satellite dish;

a mounting arm coupled to the main dish cover, the mounting arm being coupled to an inner surface of the back panel and extending out of the installation aperture; and a mounting clamp coupled to the mounting arm, the mounting clamp being adjustably coupled to the mounting arm and being configured to selectively engage a support post of the satellite dish.

2. The satellite dish cover apparatus of claim 1 further comprising a mounting clip coupled to the feed horn cover arm, the mounting clip being configured to selectively engage a feed horn extension arm of the satellite dish.

3. The satellite dish cover apparatus of claim 2 further comprising the mounting clip comprising a pair of curved spring arms, the pair of curved spring arms forming an omega-shape and being flexible such that the mounting clip will spread when pressed onto the feed horn extension arm and then reboundingly close to secure the feed horn extension within a retention area adjacent the feed horn cover arm.

4. The satellite dish cover apparatus of claim 1 further comprising the main dish cover having a truncated bottom side, the bottom edge of the front panel being linear.

5. The satellite dish cover apparatus of claim 4 further comprising the truncated bottom side making the perimeter of the front panel between 270° and 330°.

6. The satellite dish cover apparatus of claim 1 further comprising the installation aperture having a parabolic profile, the mounting arm extending through an apex of the parabolic profile.

7. The satellite dish cover apparatus of claim 1 further comprising the back side of the feed horn cover hood being curved.

8. The satellite dish cover apparatus of claim 1 further wherein the mounting clamp further comprises:

a clamp body, the clamp body having an arm aperture extending from an upper side through a lower side, the arm aperture slidingly receiving the mounting arm;

an adjustment knob coupled to the clamp body, the adjustment knob having a first threaded pin selectively engaged with a threaded adjustment aperture extending through a rear side of the clamp body into the arm aperture, a first twist handle being coupled to the first pin to engage the first pin with the mounting arm;

a pair of post tongues coupled to the clamp body, the pair of post tongues extending in parallel from a front end of the clamp body to form a post channel therebetween, the post channel being configured to slidingly receive the support post of the satellite dish; and an engagement knob coupled to the pair of post tongues, the engagement knob having a second threaded pin selectively engaged with a threaded engagement aperture extending through one of the post tongues into the post channel, a second twist handle being coupled to the second pin to engage the second pin with the support post.

9. The satellite dish cover apparatus of claim 8 further comprising the pair of post tongues being joined to form a U-shape.

10. The satellite dish cover apparatus of claim 8 further comprising each of the first twist handle and the second twist handle having a plurality of radial grip grooves.

11. The satellite dish cover apparatus of claim 8 further comprising the rear side being curved.

12. The satellite dish cover apparatus of claim 1 further comprising an outer end of each of the pair of post tongues being semicircular.

13. The satellite dish cover apparatus of claim 1 further comprising the mounting arm lying in a plane forming an angle between 20° and 45° with a plane of the front panel.

14. A satellite dish cover apparatus comprising:

a main dish cover, the main dish cover comprising a circular front panel, a perimeter extension perpendicularly extending from a perimeter of the front panel, and a rounded back panel extending from the perimeter extension forming a dish cavity therebetween, the main dish cover having a truncated bottom side, a bottom edge of the front panel being linear, the truncated bottom side making the perimeter of the front panel between 270° and 330°, the rounded back panel having an installation aperture extending therethrough and configured to receive a satellite dish into the dish cavity such that a front face of the satellite dish is fully covered by the front panel, the installation aperture having a parabolic profile;

a feed horn cover arm coupled to the main dish cover, the feed horn cover arm being coupled to the bottom edge of the front panel and flexibly extending up towards an orthogonal central axis of the front panel;

a mounting clip coupled to the feed horn cover arm, the mounting clip being configured to selectively engage a feed horn extension arm of the satellite dish, the mounting clip comprising a pair of curved spring arms, the pair of curved spring arms forming an omega-shape and being flexible such that the mounting clip will spread when pressed onto the feed horn extension arm and then reboundingly close to secure the feed horn extension within a retention area adjacent the feed horn cover arm;

a feed horn cover hood coupled to the feed horn cover arm, a curved back side of the feed horn cover hood being coupled to a distal end of the feed horn cover arm and having a front side separated from the back side, a left side separated from a right side, and a top side separated from an open bottom side to form a feed horn cavity configured to receive the feed horn of the satellite dish;

a mounting arm coupled to the main dish cover, the mounting arm being coupled to an inner surface of the back panel and extending out of the installation aperture, the mounting arm extending through an apex of the parabolic profile of the installation aperture, the mounting arm lying in a plane forming an angle between 20° and 45° with a plane of the front panel; and a mounting clamp coupled to the mounting arm, the mounting clamp comprising:

a clamp body, the clamp body having an arm aperture extending from an upper side through a lower side, the arm aperture slidingly receiving the mounting arm;

an adjustment knob coupled to the clamp body, the adjustment knob having a first threaded pin selectively engaged with a threaded adjustment aperture extending through a curved rear side of the clamp body into the arm aperture, a first twist handle being coupled to the first pin to engage the first pin with the mounting arm;

a pair of post tongues coupled to the clamp body, the pair of post tongues extending in parallel from a front end of the clamp body to form a post channel therebetween, the pair of post tongues being joined to form a U-shape, an outer end of each of the pair of post tongues being semicircular, the post channel being configured to slidingly receive a support post of the satellite dish; and an engagement knob coupled to the pair of post tongues, the engagement knob having a second threaded pin selectively engaged with a threaded engagement aperture extending through one of the post tongues into the post channel, a second twist handle being coupled to the second pin to engage the second pin with the support post, each of the first twist handle and the second twist handle having a plurality of radial grip grooves.

* * * * *